US011766123B2

(12) United States Patent
Feng et al.

(10) Patent No.: US 11,766,123 B2
(45) Date of Patent: Sep. 26, 2023

(54) UNFOLDING DEVICE OF SOFA

(71) Applicant: JASON FURNITURE (HANGZHOU) CO., LTD., Zhejiang (CN)

(72) Inventors: Yuanfeng Feng, Zhejiang (CN); Sheng Wang, Zhejiang (CN); Linlin Wu, Zhejiang (CN); Zhiyu Wang, Zhejiang (CN)

(73) Assignee: JASON FURNITURE (HANGZHOU) CO., LTD., Zhejiang (CN)

( * ) Notice: Subject to any disclaimer, the term of this patent is extended or adjusted under 35 U.S.C. 154(b) by 0 days.

(21) Appl. No.: 17/989,757

(22) Filed: Nov. 18, 2022

(65) Prior Publication Data

US 2023/0172356 A1 Jun. 8, 2023

(51) Int. Cl.
*A47C 1/04* (2006.01)
*A47C 1/034* (2006.01)
*A47C 17/04* (2006.01)

(52) U.S. Cl.
CPC ..... *A47C 1/0342* (2013.01); *A47C 17/04* (2013.01)

(58) Field of Classification Search
CPC ..... A47C 1/0342; A47C 1/034; A47C 17/04; A47C 7/506
USPC ..... 297/68
See application file for complete search history.

(56) References Cited

U.S. PATENT DOCUMENTS

| | | | | |
|---|---|---|---|---|
| 11,564,496 | B1 * | 1/2023 | Li | A47C 1/034 |
| 11,638,483 | B2 * | 5/2023 | Sun | A47C 1/0355 297/75 |
| 2014/0132038 | A1 * | 5/2014 | Lu | A47C 1/035 297/68 |
| 2015/0054315 | A1 * | 2/2015 | Donovan | A47C 1/0345 297/325 |
| 2017/0135486 | A9 * | 5/2017 | Lawson | A47C 7/00 |

FOREIGN PATENT DOCUMENTS

| | | |
|---|---|---|
| CN | 111820648 | * 10/2020 |
| CN | 113907551 | * 1/2022 |
| CN | 114568875 | * 6/2022 |

* cited by examiner

*Primary Examiner* — Mark R Wendell
(74) *Attorney, Agent, or Firm* — COOPER LEGAL GROUP, LLC

(57) ABSTRACT

The present application relates to an unfolding device of sofa, including a base. A side plate is provided above the base, and a connecting rod assembly is connected between the side plate and the base; the side plate is provided with a mounting assembly for connecting to a sitting portion; a footrest assembly and a backrest connecting member is mounted on and rotatably connected with the side plate; the base is provided with a driving assembly, configured for driving the footrest assembly to rotate and the side plate to move towards a front of the unfolding device.

11 Claims, 4 Drawing Sheets

UNFOLDING DEVICE OF SOFA

CROSS-REFERENCE TO RELATED APPLICATION

The present application claims the priority to China patent application No. 202123026037.6, filed on Dec. 2, 2021. The entirety of China patent application No. 202123026037.6 is hereby incorporated by reference herein and made a part of this specification.

TECHNICAL FIELD

The present application relates to a field of house furnishings, in particularly, to an unfolding device of a zero-gravity functional sofa.

BACKGROUND ART

At present, there are various kinds of functional sofas available in the market. For example, a multi-state functional foldable sofa having a folded sitting state, a semi-folded TV-watching state and a fully folded lying state includes a sitting portion, a backrest portion, a footrest portion, and an unfolding device in a linkage connection with the sitting portion, the backrest portion and the footrest portion. When the footrest portion is unfolded outwards and the backrest portion remains unchanged, the sofa is changed from the sitting state to the TV-watching state. When the backrest portion is rotated backwards, the sofa is changed from the TV-watching state to the lying state.

However, the lying state of current functional sofa usually cannot function well for relaxing, since they often have a limited angle for laying the backrest portion rotating flat, so that a "flat lying state" cannot be really achieved when the sofa is in the so-called lying state. In this state, a height of a heart of a person still does not go down to a height near a foot, and the heart still has to do a lot of work for circulating blood to the foot, which results in an insufficient relaxation.

SUMMARY

In order to improve a relaxing effect of a functional sofa in a lying state on a human body, the present application provides an unfolding device of a zero-gravity functional sofa.

The present application provides a unfolding device of zero-gravity functional sofa, adopting the following technical solutions.

The unfolding device of a zero-gravity functional sofa includes a base, and a side plate is provided above the base, and a connecting rod assembly is connected between the side plate and the base; the side plate is provided with a mounting assembly for connecting to a sitting portion; a footrest assembly for connecting with a footrest portion and a backrest connecting member for connecting with a backrest portion is mounted on and rotatably connected with the side plate; the base is provided with a driving assembly, configured for driving the footrest assembly to rotate and the side plate to move towards a front of the unfolding device; the side plate is configured to have a first end close to the backrest connecting member lower than a second end close to the footrest assembly during a process of the driving assembly driving the side plate to move towards the front of the unfolding device, and the mounting assembly is configured to have an included angle a relative to a horizontal plane, wherein $27° \leq a \leq 50°$, when the unfolding device is in a lying state.

In the above embodiments, after changing the sofa from a TV-watching state to a lying state, the footrest assembly is unfolded completely, the whole side plate and the backrest connecting member connected with the side plate are moved forwards, while the end of the side plate close to the backrest connecting member is tilted downwards, so that a greater height difference between the footrest assembly and the backrest connecting member is achieved. Thus, the height of a user's heart is lowered relative to the foot, so as to lower the blood circulation pressure. For example, a maximum included angle in some embodiments can be nearly 50°, at which a user can have a feeling of "zero-gravity".

In some embodiments, the side plate includes two sub-plates positioned in a same plane and having an acute included angle therebetween; and the mounting assembly includes at least two mounting pieces, in which each of the two sub-plates is provided with at least one mounting piece.

In the above embodiments, a triangle stable structure can be formed to facilitate a stable connection to the sitting portion.

In some embodiments, each connection area between the connecting rod assembly and each sub-plate is located below the mounting piece on the sub-plate.

In the above embodiments, a risk of interference of a connection area between the sitting portion and the mounting assembly from other rods groups can be reduced.

In some embodiments, the mounting assembly includes at least one mounting piece, and at least one mounting piece is integrated with the side plate.

In the above embodiments, no additional mounting piece is required, and a cost is reduced.

In some embodiments, the mounting assembly includes at least one mounting piece, and at least mounting piece is detachably connected with the side plate.

In the above embodiments, it is convenient to adjust an angle and state of the mounting piece to adapt to different inclination degrees.

In some embodiments, the mounting piece is configured to have an upper surface having an included angle of between 27° and 50° with the horizontal plane when the unfolding device is in the lying state.

In the above embodiments, a limited range of the mounting piece is provided.

In some embodiments, the connecting rod assembly is connected to a first side of the side plate, and the mounting assembly is provided at a second side of the side plate.

In the above embodiments, the effect of the connection between the sitting portion and the mounting assembly on an operation of other rods groups is reduced.

In some embodiments, the connecting rod assembly includes a first curved arm and a second curved arm, and a set of linkage rods connected between the first curved arm and the second curved arm;

the set of linkage rods includes a linkage piece, a first linkage rod and a second linkage rod; a first end of the linkage piece is rotatably connected to an end of the first curved arm close to the backrest connecting member, and a second end of the linkage piece is rotatably connected to the side plate; two ends of the second linkage rod are rotatably connected to the side plate and an end of the second curved arm close to the footrest assembly respectively, and two ends of the first linkage rod are rotatably connected to a middle of the linkage piece and a middle of the second linkage rod respectively.

In the above embodiments, by a linkage of the above rods, it can be finally realized the side plate moves with the drive shaft, and finally an angle of the sitting portion can be changed.

In some embodiments, the linkage piece is rotatably connected with a backrest linkage rod, and an end of the backrest linkage rod is rotatably connected with the backrest connecting member, and the backrest connecting member is rotatably connected with the side plate; the backrest connecting member, the backrest linkage rod, the side plate and the linkage piece form a four rods structure.

In the above embodiments, the backrest connecting member can be rotated relative to the side plate, so as to increase a rotating angle of a backrest portion to achieve to a function of "lying".

In some embodiments, the driving assembly includes a driving shaft passing through the side plate, a first crank fixedly connected to a peripheral wall of the driving shaft and a driving subassembly configured for pushing an end of the first crank away from the driving shaft to move towards the front of the unfolding device; the driving shaft is also connected with the footrest assembly; and the first crank is configured to be rotated by the driving subassembly circumferentially around the driving shaft to turn the footrest assembly over when the end of the first crank away from the driving shaft is located below the driving shaft, the driving subassembly pushes the first crank to rotate, and to pull the driving shaft towards the front of the unfolding device when the end of the first crank away from the driving shaft is rotated to a front of the driving shaft.

In the above embodiments, a switching among the three states can be realized only by a driving of the driving subassembly, and a cost of a driving source can be reduced accordingly.

In some embodiments, two sets of the side plate, the connecting rod assembly, the footrest assembly and the backrest connecting member are provided and symmetrically arranged relative to each other.

In the above embodiments, an operation stability can be improved.

In summary, the present application can achieve at least one of the following beneficial technical effects by providing the unfolding device of the zero-gravity functional sofa.

After changing the sofa from the TV-watching state to the lying state, the footrest assembly is unfolded completely, and the whole side plate and the backrest connecting member connected with the side plate are moved forwards, while the end of the side plate close to the backrest connecting member is tilted downwards, so that the greater height difference between the footrest assembly and the backrest connecting member is achieved. Thus, the height of the user's heart is lowered relative to the foot, so as to lower the blood circulation pressure. For example, the maximum included angle in some embodiments can be nearly 50°, at which the user can have a feeling of "zero-gravity".

DETAILED DESCRIPTION

The present application will be further illustrated in detail below in combination with FIGS. 1-4.

The embodiments of the present application disclose an unfolding device of a sofa.

Figure 1:
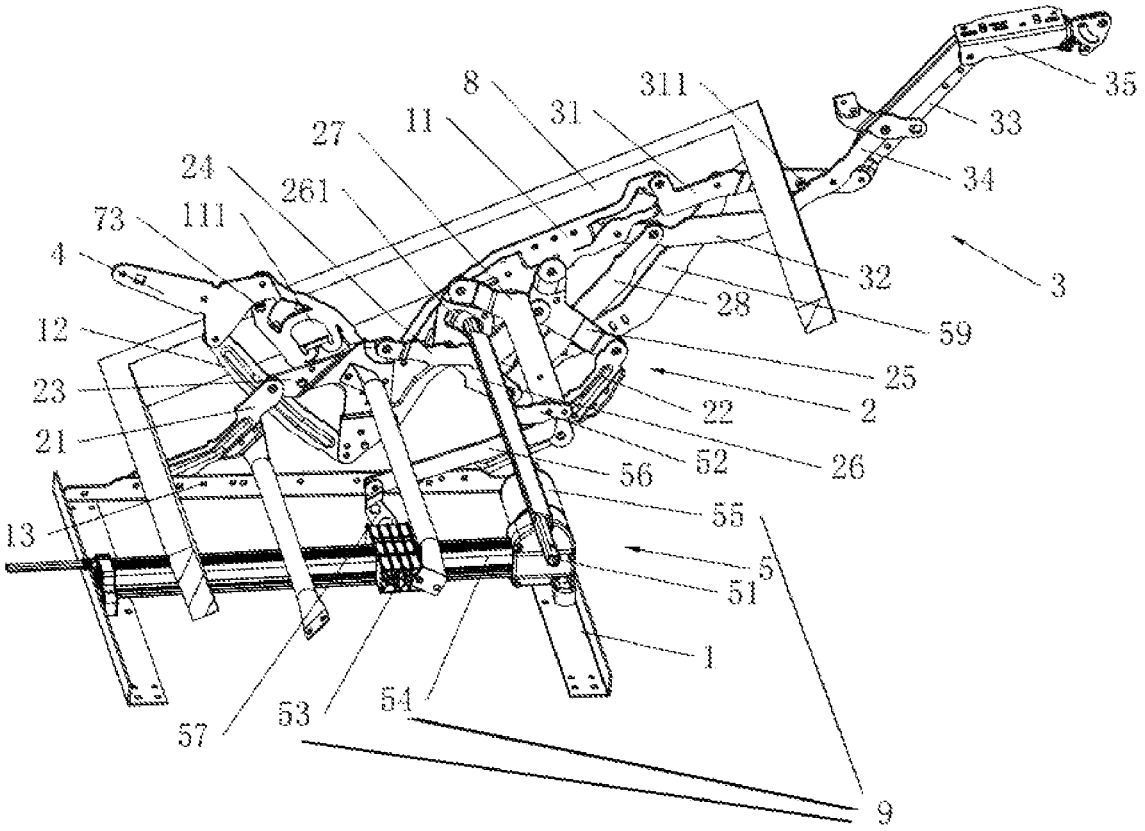
FIG. 1 is a structural diagram of an embodiment of the present application in a lying state, half of which is omitted.

Referring to FIG. 1, the unfolding device includes a frame shaped base 1, and an upper of each of two sides of the base 1 is provided with a roughly V-shaped side plate 11. A connecting rod assembly 2 is connected between the side plate 11 and the base 1. A footrest assembly 3 for connecting with a footrest portion and a backrest connecting member 4 for connecting with a backrest portion is mounted and rotatably connected with the side plate 11. The base 1 is provided with a driving assembly 5, which is located between two side plates 11, and configured for driving the footrest assembly 3 to rotate and the side plate 11 to move towards a front of the unfolding device.

In this embodiment, the front of the unfolding device is a front that a user faces when sitting on the sofa. The footrest assembly 3 is provided at a front of the side plate 11, and the backrest connecting member 4 is provided at a back of the side plate 11. The footrest portion can be a plate-shaped structure configured for supporting a leg and a foot of the user, and the backrest portion can be a hard backrest.

The driving assembly 5 can drive the unfolding device to complete a sequential switching among three states. That is, the driving assembly 5 can drive the unfolding device to change from a sitting state to a TV-watching state, and from the TV-watching state to a lying state, and reset from the lying state to the sitting state.

Figure 2:
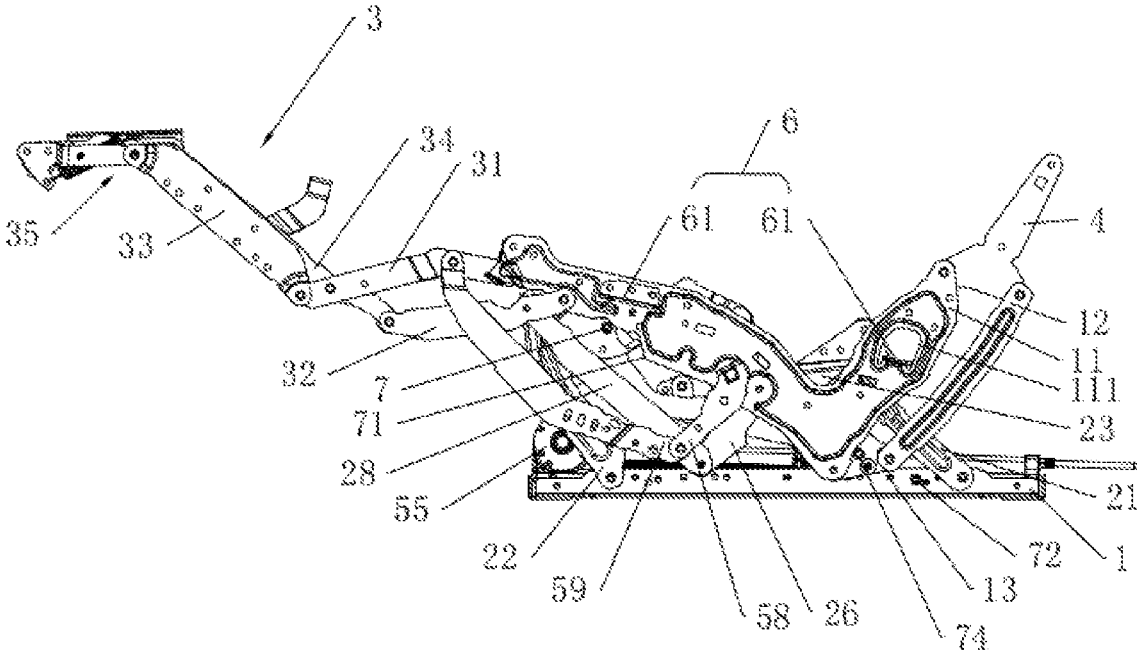
FIG. 2 is a schematic side view of an embodiment of the present application in a TV-watching state.

Referring to FIG. 1 and FIG. 2, the footrest assembly 3 includes a first footrest rod 31 and a second footrest rod 32, which are rotatably connected to the side plate 11, and a first transmission rod 33 rotatably connected to the first footrest rod 31 and a second transmission rod 34 rotatably connected to the second footrest rod 32. The first footrest rod 31 crosses and is rotatably connected with the second transmission rod 34. A footrest plate 35 is provided between an end of the first transmission rod 33 away from the first footrest rod 31 and an end of the second transmission rod 34 away from the second footrest rod 32. The side plate 11, the first footrest rod 31, the second footrest rod 32 and the second transmission rod 34 form a four rods structure, and the first footrest rod 31, the second transmission rod 34, the first transmission rod 33 and the footrest plate 35 also form the four rods structure. Thus, when any one of the first footrest rod 31 and the second footrest rod 32 is rotated, the whole footrest assembly 3 can be driven to fold up or unfold, thereby fold or unfold the footrest portion connected with the footrest plate 35.

Referring to FIG. 1 and FIG. 2, the driving assembly 5 includes a driving shaft 51 passing through the side plate 11, a first crank 52 fixedly connected to a peripheral wall of the driving shaft 51 and a driving subassembly 9 configured for pushing an end of the first crank 52 away from the driving shaft 51 to move towards the front of the unfolding device. The driving subassembly 9 can be selected as an electric cylinder, including a sliding piece 53, a guide rail 54 and a motor 55. The sliding piece 53 moves in a direction of the front and back of the unfolding device. A side wall of the sliding piece 53 is rotatably connected with a third crank 57, and an upper end of the third crank 57 is rotatably connected with a second crank 56, and an end of the second crank 56 away from the third crank 57 is rotatably connected to the end of the first crank 52 away from the driving shaft 51.

A shaft section of the driving shaft 51 is roughly square. An end of the driving shaft 51 is snap connected with a first input rod 58, and an end of the first input rod 58 away from the driving shaft 51 is rotatably connected with a second input rod 59, and an end of the second input rod 59 is rotatably connected with the first footrest rod 31.

When in the sitting state, an end of the first crank 52 away from the driving shaft 51 is located below the driving shaft 51, and the sliding piece 53 also is close to a back of the unfolding device. Thus, after the driving assembly 5 is started, the first crank 52 is pushed to rotate in a circumferential direction around the driving shaft 51 first, and the second input rod 59 is driven to rotate, so that the footrest assembly 3 is driven to rotate and unfold. When the end of the first crank 52 away from the driving shaft 51 is rotated to a front of the driving shaft 51, a state is TV-watching state. Then, the driving subassembly 9 can pull the driving shaft 51 towards the front of the unfolding device by the first crank 52, during which the footrest assembly 3 is merely translated, without relative rotation.

Additionally, it is also worth noting that, the first footrest rod 31 is provided with a fifth positioning piece 311. When the unfolding device is unfolded to be in the TV-watching state or the lying state, the fifth positioning piece 311 abuts against a rod wall of the second transmission rod 34 to prevent an included angle between the first footrest rod 31 and the second transmission rod 34 from decreasing, so that the footrest assembly 3 is more stable.

Referring to FIG. 1 and FIG. 2, the connecting rod assembly 2 includes a first curved arm 21 and a second curved arm 22, which are rotatably connected to the base 1, and a set of linkage rods connected between an upper end of the first curved arm 21 and an upper end of the second curved arm 22. The first curved arm 21 is provided close to the backrest connecting member 4, and the second curved arm 22 is provided close to the footrest assembly 3.

The set of linkage rods includes a linkage piece 23, a first linkage rod 24 and a second linkage rod 25. A middle of the linkage piece 23 bulges to a side and is roughly ">" shaped. One end of the linkage piece 23 is rotatably connected to the upper end of the first curved arm 21, and another end of the linkage piece 23 is rotatably connected to the side plate 11. Two ends of the second linkage rod 25 are rotatably connected to the side plate 11 and the upper end of the second curved arm 22 respectively, and two ends of the first linkage rod 24 are rotatably connected to the middle of the linkage piece 23 and a middle of the second linkage rod 25 respectively.

A middle of the second curved arm 22 is rotatably connected with a fourth linkage rod 27, and an upper end of the fourth linkage rod 27 is rotatably connected with a third linkage rod 26. A lower end of the third linkage rod 26 away from the fourth linkage rod 27 is rotatably connected with a fifth linkage rod 28, and an end of the fifth linkage rod 28 away from the third linkage rod 26 is rotatably connected to the second footrest rod 32. The third linkage rod 26 is provided with a moving through slot 261, and the driving shaft 51 passes through and can moves in the moving through slot 261.

During a process of changing the sofa from the sitting state to the TV-watching state, the driving shaft 51 will not affect a movement of the side plate 11, that is, a position of the side plate 11 will not be changed. During a process of changing from the TV-watching state to the lying state, the driving shaft 51 drives the side plate 11 to move forward. At this time, because the second linkage rod 25 is limited by the second curved arm 22, the second linkage rod 25 rotates relative to the side plate 11, and a rotating point is at a state where the second linkage rod 25 is connected with the side plate 11. Thus, the first linkage rod 24 moves slower than the side plate 11. Meanwhile, under a pulling limit of the first curved arm 21, the linkage piece 23 rotates counterclockwise (as shown in FIG. 1). Meanwhile, during the whole process, an end of the side plate 11 close to the backrest connecting member 4 is lower than the end of the side plate 11 close to the footrest assembly 3, thereby a height of a user's heart relative to the foot is lowered, and the blood circulation pressure is reduced.

During the process of changing from the sitting state to the TV-watching state, the fourth linkage rod 27 is hardly rotated, and the third linkage rod 26 is rotated with the fifth linkage rod 28. During a process of changing from the TV-watching state to the lying state, the fourth linkage rod 27 is also rotated clockwise with a downward rotation of the second curved arm 22 (see FIG. 1).

The connecting rod assembly 2 is located at a side of the side plate 11 close to the driving assembly 5, and the other side of the side plate 11 is provided with a mounting assembly 6 for connecting a sitting portion. The mounting assembly 6 includes two mounting pieces 61, and the sitting portion includes a frame body 8 and a cushion (not shown in figures). The frame body 8 is connected with the mounting piece 61. The side plate 11 includes two sub-plates positioned in a same plane and having an acute included angle therebetween, that is, the side plate 11 is roughly V-shaped. The two mounting pieces 61 are provided at the two sub-plates respectively. In particular, each connection area between the connecting rod assembly 2 and each sub-plate is located below the mounting piece 61 on this sub-plate.

The sub-plate of the backrest connecting member 4 is provided with a n-shaped cutting seam 111, and a portion of the sub-plate surrounded by the cutting seam 111 can be bent outwards to form the mounting piece 61. That is, this mounting piece 61 is integrated with the side plate 11. The mounting piece 61 at the sub-plate close to the footrest assembly 3 is detachably connected with the side plate 11 with a bolt.

When the unfolding device is in the lying state, an included angle between a plane where the mounting assembly 6 is located and a horizontal plane is a, and upper surfaces of all of the mounting pieces are located in the same plane, that is, the plane where the mounting assembly 6 is located. In some embodiments, $27° \leq a \leq 50°$. In some specific embodiments, $a=50°$. When the unfolding device is in the lying state, the user can has a feel of "zero-gravity".

Referring to FIG. 1 and FIG. 2, the linkage piece 23 is rotatably connected with a backrest linkage rod 12. An end of the backrest linkage rod 12 is rotatably connected with the backrest connecting member 4. The backrest connecting member 4 is rotatably connected with the side plate 11. The backrest connecting member 4, the backrest linkage rod 12, the side plate 11 and the linkage piece 23 form the four rods structure.

During the process of changing the sofa from the sitting state to the TV-watching state, the driving shaft 51 will not affect the movement of the side plate 11, that is the state of the side plate 11 will not change basically, thus the backrest connecting member 4 will not rotate and move. During the process of changing from the TV-watching state to the lying state, as the linkage piece 23 rotates, the four rods structure at the backrest connecting member 4 will changes, that is, the backrest connecting member 4 will rotate backwards.

Figure 3:
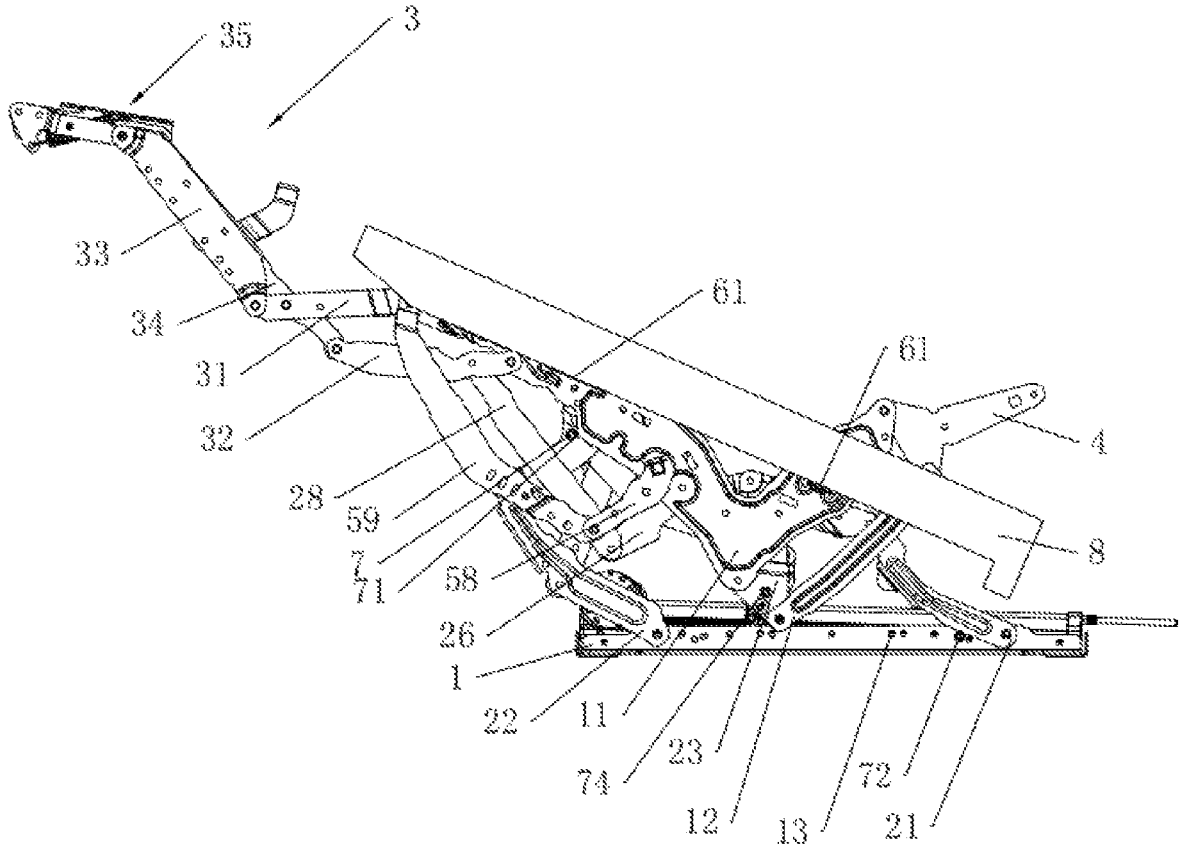
FIG. 3 is a schematic side view of an embodiment of the present application in the lying state.

Referring to FIG. 3, the second linkage rod 25 is provided with a first positioning piece 7, and the side plate 11 is provided with a first abutting portion 71. When the unfolding device extends to be in the lying state, the first positioning piece 7 abuts against the first abutting portion 71 and prevents the side plate 11 from continuing to move. A direction of a force applied by the first positioning piece 7 to the first abutting portion 71 is opposite to a direction of a movement of the side plate 11.

Referring to FIG. 2 and FIG. 3, the base 1 is provided with a second positioning piece 72. When the unfolding device extends to be in the lying state, the second positioning piece 72 abuts against the first curved arm 21 and prevents the first curved arm 21 from continuing to move. When the unfolding device is in the lying state, the second positioning piece 72 not only limits a rotation of the first curved arm 21, but also supports the first curved arm 21, which improves overall support character. The base 1 is provided with several mounting holes 13 for mounting the second positioning piece 72, thus in an actual mounting process, the appropriate mounting hole 13 can be selected according to a specific mounting state, which improves an installation adaptability.

Referring to FIG. 1, the side plate 11 is provided with third positioning piece 73. When the unfolding device extends to be in the lying state, the third positioning piece 73 abuts against the backrest connecting member 4 and prevents the backrest connecting member 4 from continuing to move. When the unfolding device is in the lying state, the third positioning piece 73 not only limits a rotation of the backrest connecting member 4, but also supports the backrest connecting member 4, which improves overall supporting performance.

Figure 4:
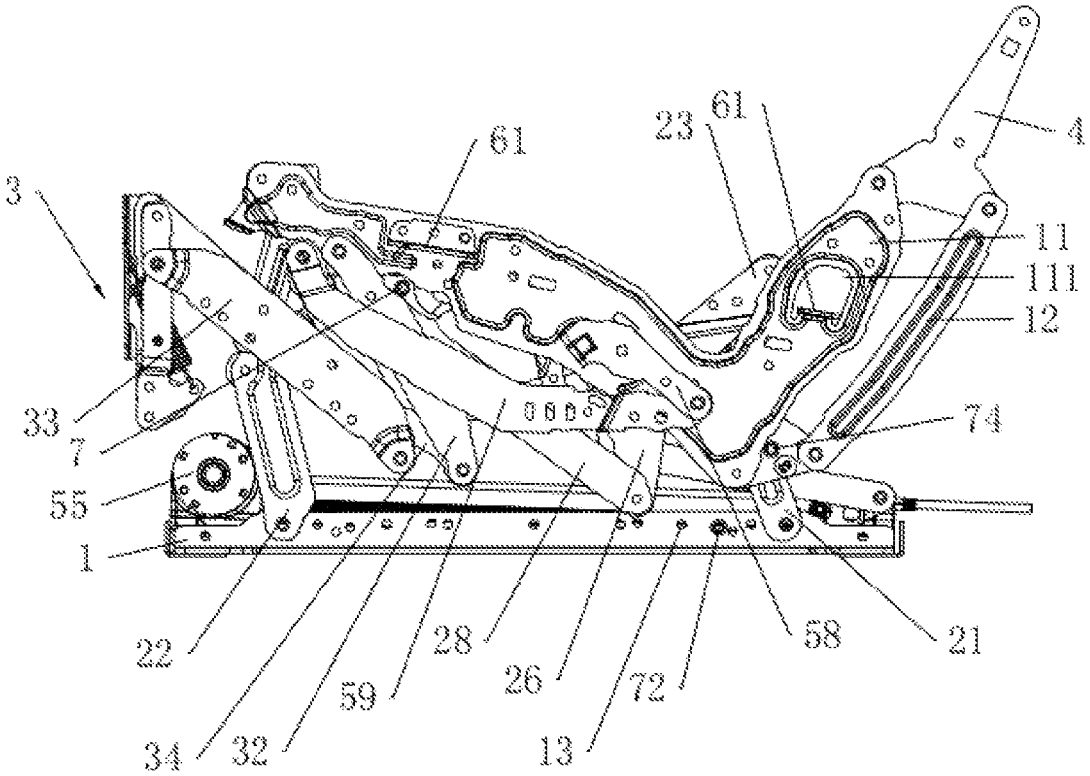
FIG. 4 is a schematic side view of an embodiment of the present application in a sitting state.

Referring to FIG. 4, the linkage piece 23 is provided with a fourth positioning piece 74. When the unfolding device extends to be in the lying state, the fourth positioning piece 74 abuts against an edge of the side plate 11 and prevents the unfolding device from continuing to retract. With the above settings, a stability of the side plate 11 can be improved when the unfolding device is in the sitting state, thereby a stability of the whole unfolding device can be improved.

It is worth noting that, a structure of each positioning piece can be selected to include a pin and a resin bushing sleeved on the pin.

An implementation principle is as follows. During the process of changing the sofa from the sitting state to the TV-watching state, the driving subassembly 9 drives the first crank 52 to rotate from a lower portion of the driving shaft 51 to the front of the driving shaft 51. During this process, the footrest assembly 3 is rotated to be unfolded. During the process of changing the sofa from the TV-watching state to the lying state, the whole side plate 11 and the backrest connecting member 4 connected with the side plate 11 move forwards, and the end of the side plate 11 close to the backrest connecting member 4 is tilted downwards at the same time, so that a height difference between the footrest assembly 3 and the backrest connecting member 4 becomes greater. Thus, the height of the user's heart relative to the foot is reduced, and the blood circulation pressure is reduced.

The above are the preferred embodiments of the present application, and does not limit the protection scope of the present application. Therefore, any equivalent changes made according to a structure, shape and principle of the present application should fall in the protection scope of the present application.

What is claimed is:

1. An unfolding device of a sofa, comprising a base, wherein a side plate is provided above the base, and a connecting rod assembly is connected between the side plate and the base; the side plate is provided with a mounting assembly; a footrest assembly and a backrest connecting member are mounted on and rotatably connected with the side plate, the base is provided with a driving assembly configured for driving the footrest assembly to rotate and the side plate to move towards a front of the unfolding device; the side plate is configured to have a first end close to the backrest connecting member lower than a second end close to the footrest assembly during a process of the driving assembly driving the side plate to move towards the front of the unfolding device, and the mounting assembly is configured to have an included angle a relative to a horizontal plane, where $27° \leq a \leq 50°$, when the unfolding device is in a lying state;

the connecting rod assembly comprises a first curved arm and a second curved arm, and a set of linkage rods connected between the first curved arm and the second curved arm; the set of linkage rods comprise a linkage piece, a first linkage rod and a second linkage rod; a first end of the linkage piece is rotatably connected to an end of the first curved arm close to the backrest connecting member, and a second end of the linkage piece is rotatably connected to the side plate; two ends of the second linkage rod are rotatably connected to the side plate and an end of the second curved arm close to the footrest assembly, respectively, and two ends of the first linkage rod are rotatably connected to a middle of the linkage piece and a middle of the second linkage rod, respectively.

2. The unfolding device of a sofa according to claim 1, wherein the side plate comprises two sub-plates positioned in a same plane and having an acute included angle therebetween; and the mounting assembly comprises at least two mounting pieces, wherein each of the two sub-plates is provided with at least one mounting piece of the at least two mounting pieces.

3. The unfolding device of a sofa according to claim 2, wherein each connection area between the connecting rod assembly and each sub-plate is located below the mounting piece on the each sub-plate.

4. The unfolding device of a sofa according to claim 3, wherein each of the at least two mounting pieces is configured to have an upper surface having an included angle of between 27° and 50° with the horizontal plane when the unfolding device is in the lying state.

5. The unfolding device of a sofa according to claim 2, wherein each of the at least two mounting pieces is configured to have an upper surface having an included angle of between 27° and 50° with the horizontal plane when the unfolding device is in the lying state.

6. The unfolding device of a sofa according to claim 1, wherein the mounting assembly comprises at least one mounting piece, and the at least one mounting piece is integrated with the side plate.

7. The unfolding device of a sofa according to claim 1, wherein the mounting assembly comprises at least one mounting piece, and the at least one mounting piece is detachably connected with the side plate.

8. The unfolding device of a sofa according to claim 1, wherein the connecting rod assembly is connected to a first side of the side plate, and the mounting assembly is provided at a second side of the side plate.

9. The unfolding device of a sofa according to claim 1, wherein the linkage piece is rotatably connected with a backrest linkage rod, and an end of the backrest linkage rod is rotatably connected with the backrest connecting member.

10. The unfolding device of a sofa according to claim 1, wherein the driving assembly comprises a driving shaft passing through the side plate, a first crank connected to the driving shaft and a driving subassembly configured for pushing an end of the first crank away from the driving shaft to move towards the front of the unfolding device; the driving shaft is also connected with the footrest assembly; and the first crank is configured to be rotated by the driving subassembly circumferentially around the driving shaft to turn the footrest assembly over when the end of the first crank away from the driving shaft is located below the driving shaft, the driving subassembly pushes the first crank to rotate, and to pull the driving shaft towards the front of the unfolding device when the end of the first crank away from the driving shaft is rotated to a front of the driving shaft.

11. An unfolding device of a sofa, comprising a base, wherein a side plate is provided above the base, and a connecting rod assembly is connected between the side plate and the base; the side plate is provided with a mounting assembly; a footrest assembly and a backrest connecting member are mounted on and rotatably connected with the side plate, the base is provided with a driving assembly configured for driving the footrest assembly to rotate and the side plate to move towards a front of the unfolding device; the side plate is configured to have a first end close to the backrest connecting member lower than a second end close to the footrest assembly during a process of the driving assembly driving the side plate to move towards the front of the unfolding device, and the mounting assembly is configured to have an included angle a relative to a horizontal plane, where $27° \leq a \leq 50°$, when the unfolding device is in a lying state;

the driving assembly comprises a driving shaft passing through the side plate, a first crank connected to the driving shaft and a driving subassembly configured for pushing an end of the first crank away from the driving shaft to move towards the front of the unfolding device; the driving shaft is also connected with the footrest assembly; and the first crank is configured to be rotated by the driving subassembly circumferentially around the driving shaft to turn the footrest assembly over when the end of the first crank away from the driving shaft is located below the driving shaft, the driving subassembly pushes the first crank to rotate, and to pull the driving shaft towards the front of the unfolding device when the end of the first crank away from the driving shaft is rotated to a front of the driving shaft.

* * * * *